US008690153B2

(12) United States Patent
Ponti

(10) Patent No.: US 8,690,153 B2
(45) Date of Patent: Apr. 8, 2014

(54) SYSTEM FOR DIRECTING SHEET ARTICLES IN ARRIVAL FROM AN INPUT LINE TOWARDS TWO OUTPUT LINES

(75) Inventor: Francesco Ponti, Cerbara-Citta'di Castello (IT)

(73) Assignee: C.M.C S.r.l., Cerbara-Citta'di Castello (Perugia) (IT)

( * ) Notice: Subject to any disclaimer, the term of this patent is extended or adjusted under 35 U.S.C. 154(b) by 0 days.

(21) Appl. No.: 13/497,612

(22) PCT Filed: Sep. 23, 2010

(86) PCT No.: PCT/IB2010/054295

§ 371 (c)(1),
(2), (4) Date: Mar. 22, 2012

(87) PCT Pub. No.: WO2011/036635

PCT Pub. Date: Mar. 31, 2011

(65) Prior Publication Data

US 2012/0261877 A1 Oct. 18, 2012

(30) Foreign Application Priority Data

Sep. 24, 2009 (IT) ..... BO2009A0611

(51) Int. Cl.
*B65H 39/10* (2006.01)
*B65H 29/58* (2006.01)
*B65H 29/60* (2006.01)

(52) U.S. Cl.
USPC ..... 271/303

(58) Field of Classification Search
USPC ..... 271/303, 69
See application file for complete search history.

(56) References Cited

U.S. PATENT DOCUMENTS

| | | | | |
|---|---|---|---|---|
| 3,815,897 | A * | 6/1974 | Hoehl et al. | 271/9.13 |
| 4,431,322 | A * | 2/1984 | Nally et al. | 400/605 |
| 5,445,368 | A * | 8/1995 | Lester et al. | 270/59 |
| 6,107,579 | A * | 8/2000 | Kinnemann | 177/145 |
| 6,460,844 | B1 * | 10/2002 | Clifford et al. | 271/9.13 |
| 2003/0080503 | A1 * | 5/2003 | Wright et al. | 271/303 |

FOREIGN PATENT DOCUMENTS

| | | | |
|---|---|---|---|
| EP | 0564291 | A | 10/1993 |
| GB | 1066558 | A | 4/1967 |

OTHER PUBLICATIONS

International Search Report for PCT/IB2010/054295, Mailed Mar. 15, 2011, 2 pages.

* cited by examiner

*Primary Examiner* — Luis A Gonzalez
(74) *Attorney, Agent, or Firm* — William J. Sapone; Ware, Fressola, Maguire & Barber LLP

(57) ABSTRACT

A system (1) for directing sheet articles (2) in arrival from an input line (L1) towards two output lines has first gripping and drawing devices for gripping and drawing the sheet articles (2) for release in a directing region (37). The sheet articles are then deviated along a first (D1) or a second (D2) orientating direction. Second gripping and drawing devices move the sheet articles (2) along the direction region. First and second counter-rotating pairs of rollers face one another and grip the sheet articles to move them towards the second (5) and third (6) gripping and drawing devices, all the devices and rollers being arranged and operating with respect to one another such that during transit through the directing region (37) the advancing sheet articles (2) are subjected to constant gripping by at least one device or one pair of rollers.

10 Claims, 3 Drawing Sheets

SYSTEM FOR DIRECTING SHEET ARTICLES IN ARRIVAL FROM AN INPUT LINE TOWARDS TWO OUTPUT LINES

TECHNICAL FIELD

The present invention relates to a system for directing sheets from an input line towards two output lines and to a method for improving an existing directing system.

BACKGROUND ART

A system of known type for directing sheets from an input line and a second output line, used for example on sheet-collecting lines, comprises: first gripping and drawing means arranged at the input line and cooperating there-with to grip the sheets and move them, keeping them gripped, in a substantially horizontal conveying direction up to releasing them in a directing region; switching means, arranged in the directing region, activatable to deviate the sheets during their release by the first gripping and drawing means respectively along a first or a second directing direction, angularly arranged with respect to the conveying direction such as to form there-with respectively a first directing angle and a second direction angle, substantially equal but in an opposite direction to the preceding; second gripping and drawing means, operating at the first outlet line and destined to grip the sheets advancing along the first direction and drawing them in a substantially parallel direction to the conveying direction; third gripping and drawing means, operating at the second output line and inferiorly arranged to the second gripping and drawing means in order to grip the sheets advancing along the second directing line and draw them with a substantially parallel direction to the conveying direction.

The first, second and third gripping and drawing means each comprise a pair of counter-rotating rollers, first and second, arranged one above the other and on which are respectively wound a first series of upper belts and a second series of lower belts; each sheet is gripped and drawn between the horizontally developing lower branches of the second series of belts.

The switcher means comprise a deviating element in the form of a wedge which is activatable to rotate between a first position, in which it directs the sheets in release stage by the belts wound on rollers of the first gripping and drawing means towards the rollers of the second gripping and drawing means, and a second position in which it directs the sheets in release phase from the first gripping and drawing means towards the rollers of the third gripping and drawing means.

The sheet directing system further comprises: first guide means, arranged between the rollers of the first gripping means and the rollers of the second gripping and drawing means for guiding the sheets in advancement along the first orientating direction; and second guide means, arranged between the rollers of the first guide and drawing means and the rollers of the third gripping and drawing means, to guide the sheets in advancement along the second orientating direction.

In order to be correctly direction, each sheet advancing in the directing system must be gripped between the belts wound on the rollers of the second or third gripping and drawing means before it is released by the belts wound on the rollers of the first gripping and drawing means, i.e. the sheet, in order to advance in the directing system and not to snag therein, causing a shut-down, must be subjected to the constant grip on the part of the first or second or third gripping and drawing means.

The above-described directing system is therefore configured such as to direct sheets having a standard format, the dimensions of which enable them to be subjected to a constant grip on the part of the first or second or third gripping and drawing means during advancing into the directing region, and exhibits drawbacks whenever it is required to use formats having smaller dimensions to the standard format, i.e. sheets whose dimensions do not enable them to be subjected to a constant grip on the part of the first or second or third gripping and drawing means.

In this case, in order to direct the sheets correctly and prevent them from getting blocked in the directing system, it is possible to modify the configuration of the directing system according to the sheet format in use, by nearing the conveyor organs comprising the rollers of the second and third gripping and drawing means to the rollers of the first gripping and drawing means; this however requires a long set-up time due to the need to modify the reciprocal positions of the rollers of the first, second and third gripping and drawing means, and adapt the guide position.

The nearing of the conveyor organs comprising the rollers of the second and third gripping and drawing means to the conveyor organ comprising the rollers of the first gripping and drawing means determines an increase in the directing angle (first and second) and, consequently, an increase in the probability of the sheet's snagging in the directing system, positively correlated to the directing angle; in order to contain the probability of blocking within acceptable limits, it is necessary to reduce the speed of supply of the sheets, which leads to an undesirable reduction in the productivity of the directing system.

Further, the directing angle must be kept below a predetermined angle, being a directing limit, as with a greater directing angle to this limit, the probability of snagging is very high and it is not possible to contain it within acceptable limits, even by reducing the sheet supply.

SUMMARY OF INVENTION

The aim of the present invention is to obviate the above-described drawbacks, i.e. to provide a technical solution which enables sheets of any format to be directed from an input line to two output lines, even where the format is smaller than standard, with a high level of productivity and short set-up times.

The above aims are obtained with a system for directing sheet articles coming from an input line towards two output lines, and by means of a method for improving an existing system for directing sheet articles.

The system comprises: first gripping and drawing means operating at and cooperating with the input line of the sheet articles which are moved in an advancement direction, in order to grip and draw the sheet articles and release them in a directing region; means arranged in the directing region for deviating the sheet articles during release thereof by the first gripping and drawing means, along a first or a second orientating direction which are angularly arranged with respect to the advancement direction; second gripping and drawing means operating at and cooperating with a first output line of the sheet articles in order to grip and draw the sheet articles reaching the directing region; third gripping and drawing means operating at and cooperating with a second output line of the sheet articles in order to grip and draw the sheet articles in arrival at the directing region; at least a first pair of counter-rotating rollers facing one another and arranged in the directing region to grip the sheet articles advancing along the first orientating direction and to move them along a third orientating direction towards the second gripping and drawing means, the first gripping and drawing means, the first pair of rollers and the second gripping and drawing means being arranged and operating with respect to one another such that during transit through the directing region the sheet articles advancing along the first and the third orientating direction are subjected to constant gripping by at least one from among the first gripping and drawing means, the first pair of rollers and the second gripping and drawing means; at least a second pair of counter-rotating rollers facing one another and arranged in the directing region to grip the sheet articles advancing along the second orientating direction and to move them along a fourth direction towards the third gripping and drawing means, the first gripping and drawing means, the second pair of rollers and the third gripping and drawing means being arranged and operating with respect to one another such that during transit through the directing region the sheet articles advancing along the second and the fourth orientating direction are subjected to constant gripping by at least one from among the first gripping and drawing means, the second pair of rollers and the third gripping and drawing means.

The first and the second pair of rollers, arranged in the directing region, advantageously enable the sheets to be held in a constant grip in their path through the direction region, transferring them from the input line to one of the two output lines and at the same time enable, with sheets of any format, even smaller than standard format, the directing angle to be kept such that the probability of snagging in the directing region is small and consequently the input speed of the sheets can be fast without causing blockage of the sheets in the direction region.

The system for directing the sheets can further comprise that the first and second pairs of counter-rotating rollers, the first a second gripping and drawing means are arranged such that the path of the sheet articles between the first gripping and drawing means and the first pair of rollers and the second gripping and drawing means are substantially equal and the second pair of counter-rotating rollers, the first and the third gripping and drawing means are arranged such that the path of the sheet articles between the first gripping and drawing means and the second pair of rollers and the path between the second pair of rollers and the third gripping and drawing means are substantially equal. This arrangement advantageously enables directing the greatest number of formats, regardless of the directing angle towards both output lines.

The aims are attained by a method for improving an existing system for directing sheet articles in arrival from an input line towards two output lines, the system comprising: first gripping and drawing means operating at and cooperating with an input line of sheet articles which are moved in an advancement direction, in order to grip and draw the sheet articles and release them in a directing region; means arranged in the directing region for deviating the sheet articles during release thereof by the first gripping and drawing means, along a first or a second orientating direction which are angularly arranged with respect to the advancement direction; second gripping and drawing means operating at and cooperating with a first output line of the sheet articles in order to drip and draw the sheet articles reaching the directing region; third gripping an d drawing means operating at and cooperating with a second output line of the sheet articles in order to grip and draw the sheet articles reaching the directing region the method comprising of stages of: mounting at least a first pair of rollers in the directing region which first pair of roller are counter rotating and opposite one another such to cooperate with one another in order to grip the sheet articles advancing along the first orientating directing and to move the sheet articles along a third orientating direction towards the second gripping and drawing means and such that during transit through the directing region the sheet articles advancing along the first and the third orientating direction are subject to a constant gripping by at least one of the first gripping and drawing means, the first pair of roller and the second gripping and drawing means; mounting at least a second pair of rollers in the directing region which second pair of rollers are counter rotating and opposite one another such as to cooperate with one another in order to grip the sheet articles advancing along the second orientating direction and to move the sheet articles along a fourth orientating direction towards the third gripping and drawing means and such that during transit through the directing region the sheet articles advancing along the second and the fourth orientating direction are subject to a contact gripping by a least one of the first gripping and drawing means.

The mounting of the first and second pair of rollers in the directing region leads to an improvement, with contained costs, in an already existing directing system, such that the system is able to direct sheets of any format, even smaller than standard.

Further, the simple mounting of the first and second pair of rollers in the directing region does not require any change of the directing angle and consequently does not alter the probability of clocking of the sheets in the directing region; this means that high productivity can be maintained in directing sheets of any format, even smaller than standard.

BRIEF DESCRIPTION OF THE DRAWINGS

Specific embodiments of the invention, and advantageous technical-functional characteristics relating to the embodiments and only in part deducible from the above description, will be described in the following description, in accordance with what is reported in the claims and with the aid of the accompanying figures of the drawings, in which:

BEST MODE FOR CARRYING OUT THE INVENTION

Figure 1:
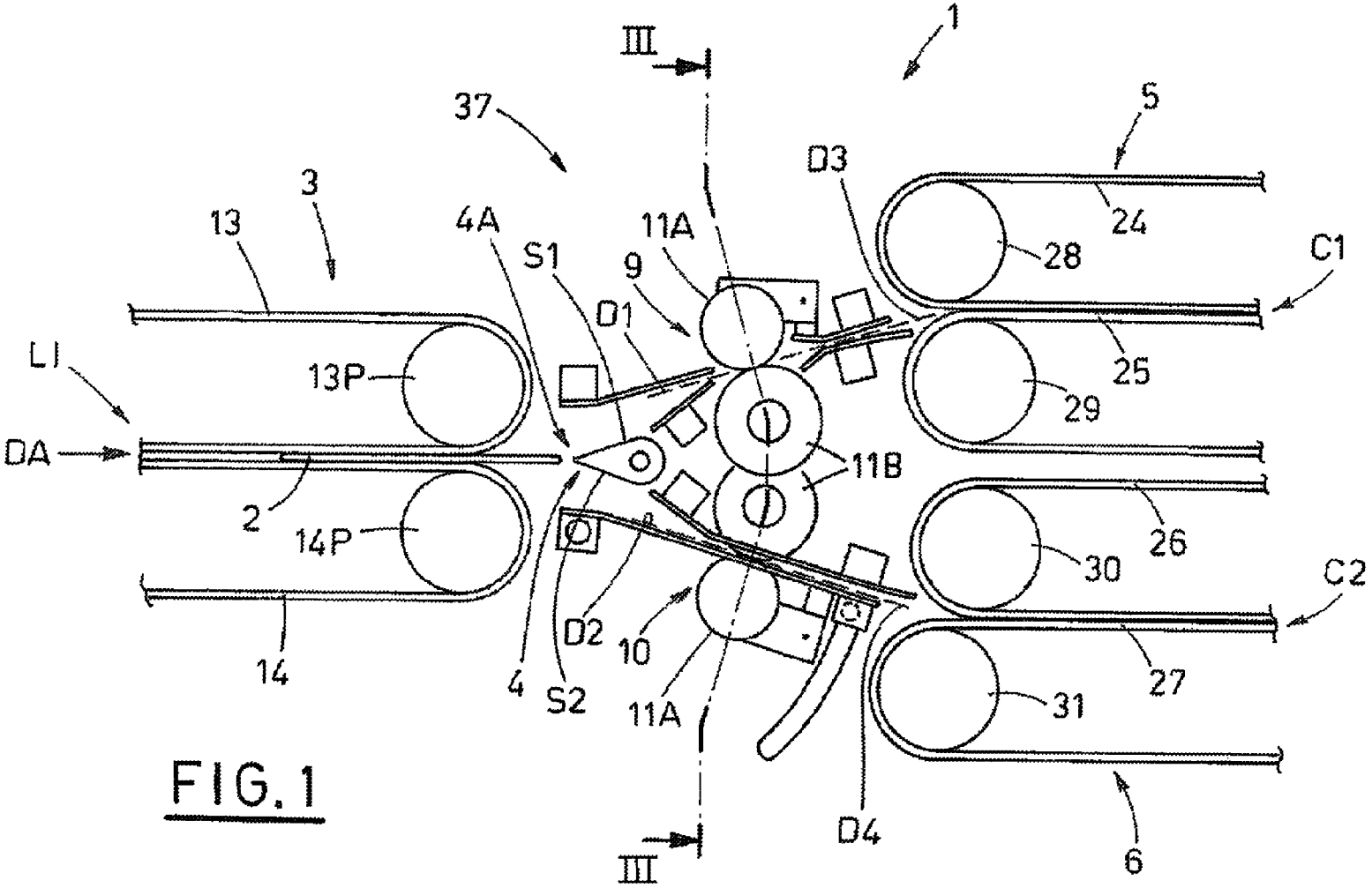
FIGS. 1 and 2 illustrate respective schematic section views of a preferred embodiment of the system for directing the sheets of the present invention.
Figure 2:
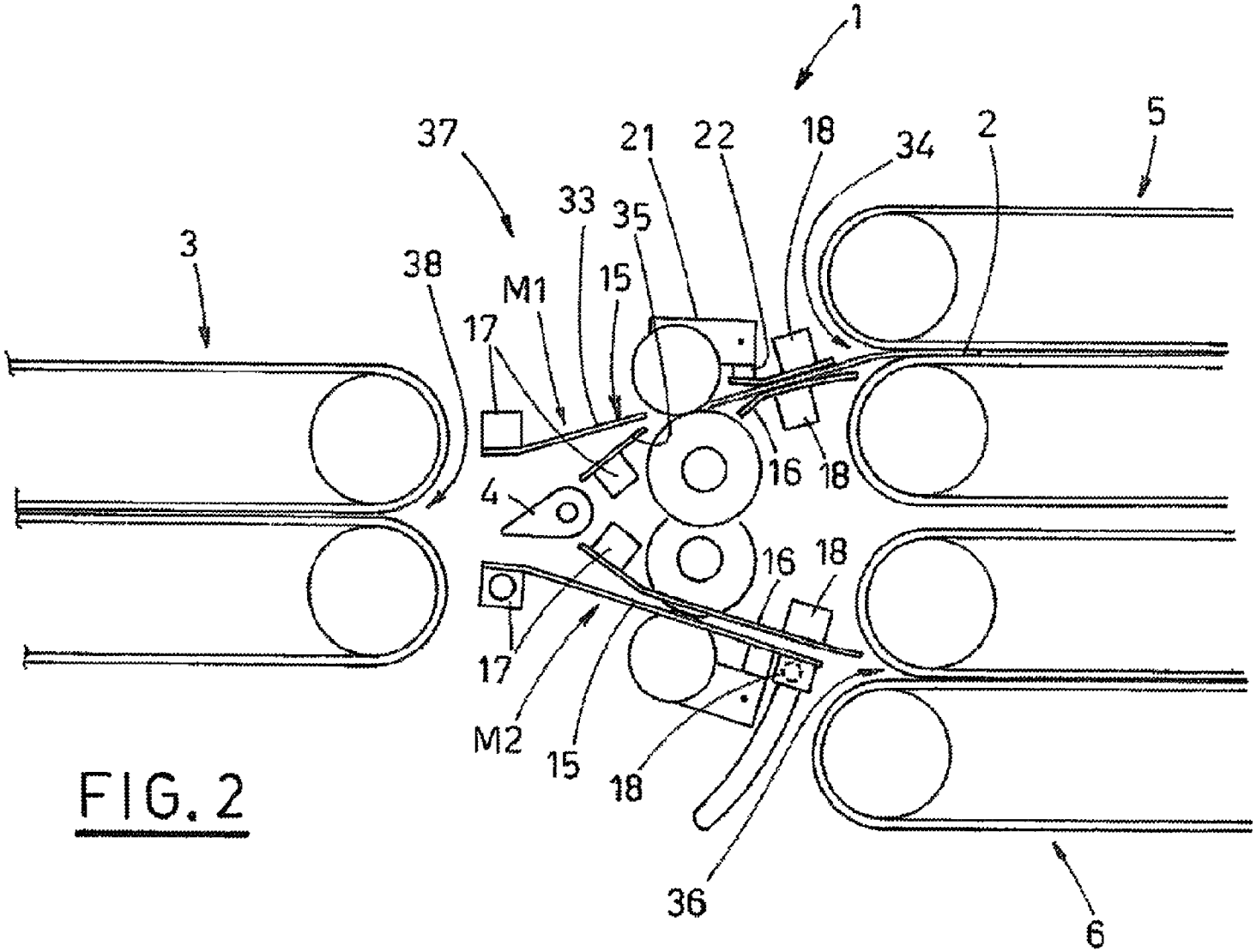

With special reference to FIGS. 1 and 2, reference number 1 denotes the system for directing the sheets 2 coming from an input line L1 towards two output lines C1, C2 object of the present invention, comprising:

first gripping and drawing means 3 operating at and cooperating with the input line L1 of the sheet articles 2 which are moved in an advancement direction DA, in order to grip and draw the sheet articles 2 and release them in a directing region 37;

means 4 arranged in the directing region 37 for deviating the sheet articles 2 during release thereof by the first gripping and drawing means 3, along a first D1 or a second D2 orientating direction which are angularly arranged with respect to the advancement direction DA;

second gripping and drawing means 5 operating at and cooperating with a first output line C1 of the sheet articles 2 in order to grip and draw the sheet articles 2 reaching the directing region 37;

third gripping and drawing means 6 operating at and cooperating with a second output line C2 of the sheet articles 2 in order to grip and draw the sheet articles 2 in arrival at the directing region 37;

a plurality of first pairs 9 of counter-rotating rollers 11A, 11B facing one another and arranged in the directing region 37 to grip the sheet articles advancing along the first orientating direction D1 and to move them along a third orientating direction D3 towards the second gripping and drawing means 5, the first gripping and drawing means 3, the first pair of rollers 9 and the second gripping and drawing means 5 being arranged and operating with respect to one another such that during transit through the directing region 37 the sheet articles 2 advancing along the first D1 and the third orientating direction D3 are subjected to constant gripping by at least one from among the first gripping and drawing means 3, the first pair 9 of rollers 11A, 11B and the second gripping and drawing means 5;

a plurality of second 10 pairs of counter-rotating rollers 11A, 11B facing one another and arranged in the directing region 37 to grip the sheet articles 2 advancing along the second orientating direction D2 and to move them along a fourth direction D4 towards the third gripping and drawing means 6, the first gripping and drawing means 3, the second pair of rollers 9 and the third gripping and drawing means 6 being arranged and operating with respect to one another such that during transit through the directing region 37 the sheet articles 2 advancing along the second D2 and the fourth orientating direction D4 are subjected to constant gripping by at least one from among the first gripping and drawing means 3, one of the second pair 9 of rollers 11A, 11B and the third gripping and drawing means 6.

The first gripping and drawing means 3 comprise, as illustrated in FIGS. 1 and 2, a first roller 13P on which is wound a first series of upper belts 13 and a second roller 14P, facing the first roller 13P, on which is wound a second series of lower belts 14; the upper 13 and lower 14 belts are destined to draw a sheet between the lower branches of the upper belts 13 and the upper branches of the lower belts 14 in the substantially-horizontal conveying direction DA.

The plane identified by the axes of the first 13P and the second rollers 14P is arranged substantially vertical, perpendicular to the conveying direction DA.

The deviating means 4 comprise a deviating element 4, arranged in the directing region, downstream of the outlet section 38 of the belts 13, 14 of the first gripping means 3 with respect to the conveying direction DA of the sheet in the first gripping and drawing means 3.

The deviating element 4 is activatable in rotation between extreme position, respectively a first position in which the element 4 directs the sheets 2 during their release by the first gripping and drawing means 3 along the first orientating direction D1, inclined upwards with respect to the conveying direction DA, and a second position in which it directs the sheets 2 during the release thereof by the first gripping and drawing means 3 along the second orientating direction D2, inclined downwards with respect to the conveying direction DA.

The portion 4A of the deviating element 4 facing the rollers 13P, 14P of the first gripping and drawing means 3 comprises a first surface S1 and a second surface S2 which form a wedge for facilitating the deviation of the sheets 2, as will be illustrated herein below with reference to the functioning of the system 1 for directing the sheets.

The first and the second orientating direction D1, D2 are angularly arranged with respect to the conveying direction DA such as to form there-with respectively a first orientating angle and a second orientating angle, substantially equal but in an opposite direction to the first.

The second gripping and drawing means 5 comprise, as illustrated in FIGS. 1 and 2, a pair of facing rollers 28, 29, upper and lower, on which a first series of upper belts 24 and a second series of lower belts 25 are respectively wound; the second gripping and drawing means 5 are destined to grip and draw a sheet between the lower branches of the upper belts 24 and the upper branches of the lower belts 25, in a substantially horizontal direction.

The plane identified by the axes of the upper roller 28 and the lower roller 29 of the second gripping and drawing means 5 is arranged slightly inclined with respect to the vertical, with the upper roller 28 arranged horizontally closer to the deviating means 4 with respect to the lower roller 29, in such a way as to facilitate the entry of the sheets advancing in the directing region 37 between the respective belts 24, 25 wound on the rollers 28, 29.

As illustrated in FIGS. 1 and 2, the third drawing means 6 comprise a facing pair of rollers 29, 30, upper and lower, arranged inferiorly of the rollers (28, 29) of the second drawing and gripping means 5 and on which respectively a first series of upper belts 26 and a second series of lower belts 27 wind; the third gripping and drawing means 6 are destined to grip and draw a sheet between the lower branches of the upper belts 26 and the upper branches of the lower belts 27 in a substantially horizontal direction.

The plane identified by the axes of the upper roller 30 and the lower roller 31 of the third gripping and drawing means 6 is arranged slightly inclined with respect to a vertical plane, with an opposite angle to the one formed by the plane identified by the axes of the upper roller 28 and the lower roller 29 with the vertical plane; this facilitates entry of the sheets between the rollers 30, 31 of the third gripping and drawing means 6.

Figure 3:
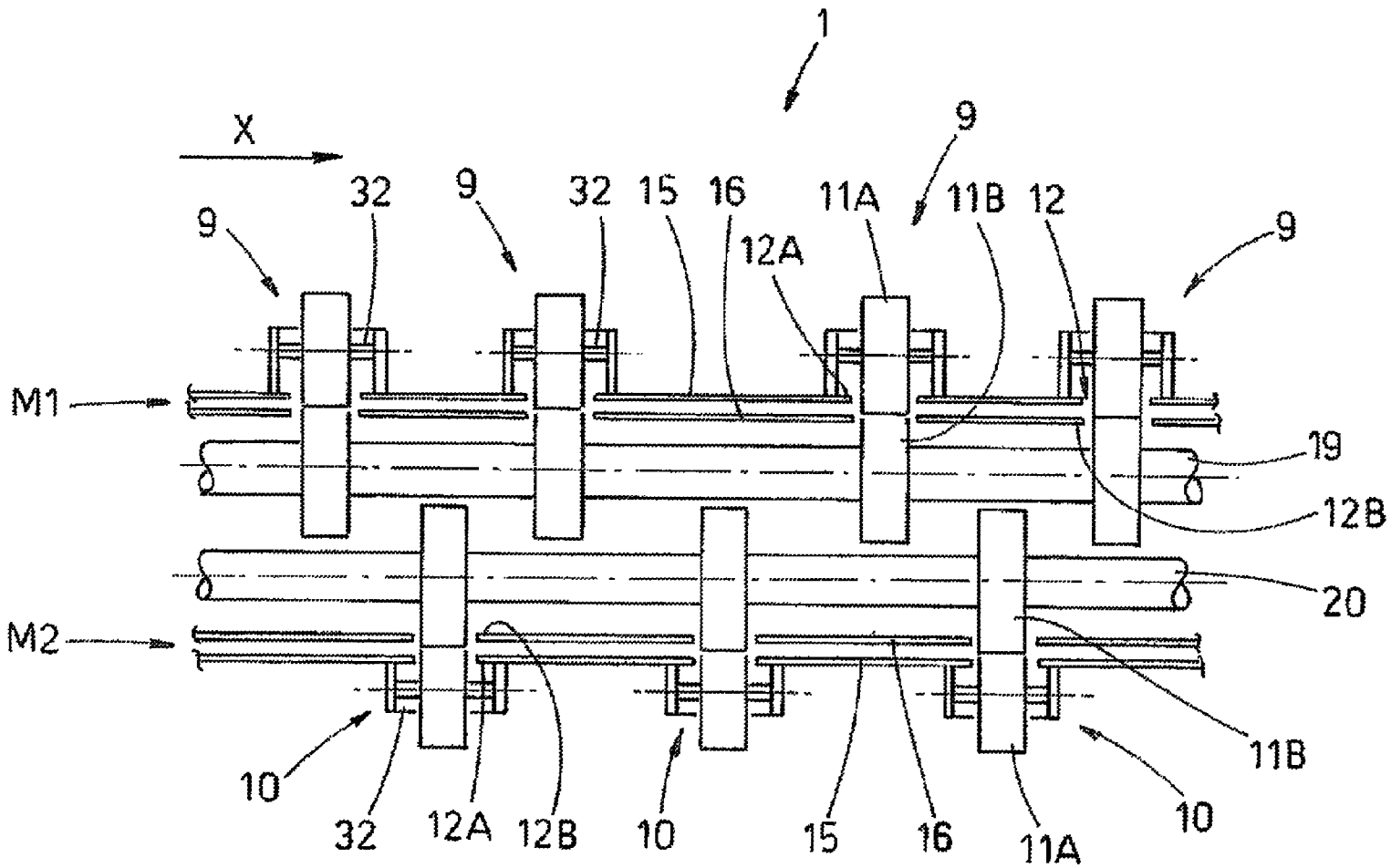
FIG. 3 is a section view of the system for directing the sheets according to the planes of section III-III of FIG. 1.

Each pair 9, 10 of the plurality of first pairs 9 and second pairs 10 of rollers (11A, 11B), with reference to FIG. 3 in which four first pairs of rollers 11A, 11B and three second pairs 10 of rollers 11A, 11B are visible, comprises a drawing roller 11B and an idle roller 11A, drawn in rotation by the relative drawing roller 11B and provided with means for maintaining it in contact with the lower roller 11B.

The drawing rollers 11B of the first pairs 9 of rollers 11A, 11B are arranged coaxially, keyed on and constrained to a first shaft 19 borne rotatably by the frame of the system in order to direct the sheets 1 and activatable in rotation by means of a motor (not illustrated); the idle rollers 11A of the first pairs of rollers 11A, 11B are arranged superiorly of the relative drawing rollers 11B and are substantially coaxial to one another but each is borne rotatably by a shaft 32 thereof.

The rollers 11A, 11B of each first pair 9 of rollers 11A, 11B are arranged with respect to one another such that the plane identified by the axes of the rollers 11A, 11B is substantially perpendicular to the first orientating direction D1; this enables the rollers 11A, 11B to grip and draw the sheets, maintaining them substantially unaltered in the orientation direction D1 thereof, i.e. the third orientation direction D3 is substantially parallel to the first orientation direction D1.

The first pairs 9 of rollers 11A, 11B are arranged between the deviating element 4 and the rollers 29, 29 of the second gripping and drawing means 5, are appropriately distanced from one another along a direction indicated in FIG. 3 by X, i.e. offset along the perpendicular direction X to the first orientation direction D1 such that the first pairs 9 of rollers 11A, 11B grip and release a sheet advancing along the first orientation direction D1 substantially contemporaneously.

Similarly to what is set out herein above for the first pairs 9 of rollers 11A, 11B, the drawing rollers 11B of the second pairs of rollers 11A, 11B are arranged coaxially, keyed on and constrained to a second shaft 20, arranged below the first shaft 20, borne rotatably by the frame of the system in order to direct the sheets 2 and activatable in rotation by means of a motor (not illustrated); the idle rollers 11A of the second pairs of rollers 11A, 11B are arranged inferiorly of the relative drawing rollers 11B and are substantially coaxial to one another but each is borne rotatably by a shaft 32 thereof.

The rollers 11A, 11B of each second pair 10 of rollers 11A, 11B are arranged with respect to one another such that the plane identified by the axes of the rollers 11A, 11B is substantially perpendicular to the second orientating direction D2; this enables the rollers 11A, 11B to grip and draw the sheets, maintaining them the orientation direction D2 thereof substantially unaltered, i.e. the fourth orientation direction D4 in which the rollers 11A, 11B of the second pairs 10 of rollers draw the sheet is parallel to the first orientation direction D2.

The second pairs 10 of rollers 11A, 11B are arranged between the deviating element 4 and the rollers 30, 31 of the third gripping and drawing means 6, are appropriately distanced from one another along a direction indicated in FIG. 3 by X, and are offset along the perpendicular direction X to the first pairs 9 of rollers 11A, 11B.

The rollers 11A, 11B of the first 9 and the second 10 pairs of rollers are also smaller with respect to the rollers 28, 29, 30, 31 of the second and the third drawing means 5, 6; in fact the rollers 28, 29, 30, 31 of the second and third drawing means 5, 6 are of such dimensions for the functioning of a conveyor of the respective output lines C1, C2 of which they are an integral part, while the rollers 11A, 11B of the first 9 and the second 10 pairs of rollers are of such dimensions only to grip and draw the sheets and thus they can be smaller in order to be advantageously inserted more easily in the orientating region.

The means for maintaining the idle rollers 11A of each first and second pair of rollers 11A, 11B in contact with the associated drawing roller 11B comprise: a pair of arms 21, destined to rotatably support the shaft 32 of the idle roller 11A and rotatably supported in turn by a support element 22 that is fixed with respect to the frame; a rotational spring (not illustrated) is associated to the arms 21 for exerting a torque on the arms 21 and for pushing the idle roller 11A into contact with the relative drawing roller 11B.

The means for maintaining the idle roller 11A of each first pair 9 of rollers in contact with the associated drawing roller 11B enables a predetermined contact pressure to be maintained between the rollers 11A, 11B sufficient for the drawing roller 11B to draw the idle roller 11A associated thereto in rotation.

The system for directing the sheets further comprises guide means M1, destined to guide the sheets 2 in advancement along the first orientation direct D1 between the deviating element 4 and the first pairs 9 of rollers 11A, 11B and the sheets 2 in advancement along the third orientation direction D3 between the first pairs 9 of rollers 11A, 11B and the second gripping and drawing means 5, and second guide means M2, destined to guide a sheet 2 in advancement along the second orientation direct D2 between the deviating element 4 and the second pairs 10 of rollers 11A, 11B and the sheets 2 in advancement along the fourth orientation direction D4 between the second pairs 10 of rollers 11A, 11B and the third gripping and drawing means 5.

The first M1 and the second M2 guide means of the sheets 2 comprise a first guide element 15 and a second guide element 16, having substantially planar developments.

The first guide element 15 of the first guide means M1 is arranged superiorly of the second guide element 16 of the first guide means M1 with a first end of the two planar surfaces 33 having greater development in proximity of the first roller 13P of the first gripping and drawing means 3 and the opposite end of the surfaces 33 in proximity of the input section 34 of the sheet into the belts 24, 25 wound on the rollers of the second gripping and drawing means 5 while the second guide element 16 of the first guide means M1 is arranged facing the first element 15 with a first end of the surfaces 35 of larger development thereof in proximity of deviating element 4 and with the opposite end of the surfaces 35 closed to the input section of the sheet into the belts wound on the rollers of the second gripping and drawing means 5; the first 15 and second 16 elements of the first guide means M1 are therefore arranged in relation to one another such as to guide the sheets in advancement along the first orientation direction D1 and the third orientation direction D3.

The first guide element 15 of the second guide means M2 is arranged inferiorly to the second guide element 16 and develops starting from the region opposite the second roller 14P of the first gripping and drawing means 3 and terminates at the input section 36 of the sheet in the belts 26, 27 wound on the rollers of the third gripping and drawing means 6, while the second guide element 16 develops starting from the deviating element 4 and terminates at the input section 36 of the sheet in the belts 26, 27 wound on the rollers of the third gripping and drawing means 6; the first 15 and second 16 element of the second guide means M2 are therefore arranged with respect to one another such as to guide the sheets in advancement along the second orientation direction D2 and the fourth orientation direction D4.

Each guide element 15, 16 of the first M1 and the second M2 guide means, first and second, is constrained to the frame by means of a pair of bars 17, 18 fixed to the opposite ends of the two elements.

Each guide element 15, 16 of the first M1 and second M2 guide means is provided with a plurality of openings 12 afforded such that a portion of a roller 11A, 11B of the first pairs 9 and the second pairs 10 of rollers inserts in each opening 12, i.e. the first element 15 is provided with openings 12A in which the idle rollers 11A insert and the second element is provided with openings 12B in which the drawing rollers 11B insert.

The following is a description of the functioning of the system 1 for directing the sheets 2 of the present invention, with reference to the directing of a sheet 2 from the input line L1 towards the first output line C1.

The first gripping and drawing means 3 draw a sheet 2 between the lower branches of the upper belts 13 and the upper branches of the lower belts 14, in the substantially horizontal conveyor direction DA in the direction of the deviating element 4.

The deviating element 4 is activated to be arranged in the first position (FIG. 2) such that the first surface S1 of the two surfaces (S1, S2) of the portion 4A of the wedge-shaped deviating element 4 abuts a portion of the sheet 2 during the stage of release of the sheet by the belts 13, 14 wound on the rollers of the first gripping and drawing means 3 and deviates it in the first orientating direction D1 towards the first pairs 9 of counter-rotating rollers 11A, 11B.

The sheet 2, drawn by the belts 13, 14 wound on the rollers of the first gripping and drawing means 3, is advanced, drawn by the belts 13, 14 wound on the rollers of the first gripping and drawing means 3, into the directing region 37 between the walls of the guide elements 15, 16 of the first guide means M1, guided by the guide elements 15, 16.

The sheet advancing along the first orientation direction D1 is gripped between the rollers 11A, 11B of the first pairs 9 of counter-rotating rollers before the belts 13, 14 wound on the rollers of the first gripping and drawing means 3 have released it; this advantageously prevents any blockage of the sheet 2 in the portion of the directing region 37 in which the sheet advances between the deviating element 4 and the first pairs 9 of counter-rotating rollers as in that portion of the directing region 37 the sheet is always gripped and drawn by the belts 13, 14 wound on the rollers of the first gripping and drawing means 3 or by the rollers 11A, 11B of the first pairs 9 of rollers.

The counter-rotating rollers 11A, 11B of the first pairs 9 of rollers draw the sheet 2 and advance it along the third orientation direction D3 and release the sheet 2 only after it has been gripped by the belts 24, 25 wound on the roller of the second gripping and drawing means 5; this advantageously prevents any snagging of the sheet 2 in the portion of the directing region 37 in which the sheet advances between the rollers 11A, 11B of the first pairs 9 of rollers and the second gripping and drawing means 5 as in the portion of the directing region 37 the sheet 2 is always gripped and drawn by the rollers 11A, 11B of the first pairs 9 of rollers or by the belts 24, 25 wound on the rollers of the second gripping and drawing means 5.

The proposed technical solution effectively directs the sheets, even those in smaller formats, as the first 9 and the second 10 pairs of counter-rotating rollers 11A, 11B exert a gripping and drawing action on the sheets in the orientating region 37, preventing the sheet from snagging in that region of the sheet-directing system.

Further, the system for directing the sheets keeps the directing angle constant, i.e. the angle of inclination of the orientating direction D1, D2 of the sheet with respect to the conveying direction DA, and below the limit value of the angle which would compromise the directing of the sheets on changing the format being processed; this advantageously enables high productivity independently of the format of the sheets in use.

An advantage of the present invention consists in having defined a system for directing the sheets which enables sheets of any format to be directed while maintaining high productivity and not requiring set-up times at the moment of change format.

In a further variant, not illustrated, the system for directing the sheets does not comprise a plurality of pairs of counter-rotating roller, first and second, but only one first pair of counter-rotating rollers and only one second pair of counter-rotating rollers.

For this variant there are the same advantageous technical-functional characteristics of the above-described preferred realization, which is cited here for reference.

In a still further variant, not illustrated, the system for directing the sheets comprises a plurality of first pair of counter-rotating rollers arranged in the directing region between the deviating means and the second gripping and drawing means, one after the other with reference to the advancement direction of the sheet through the directing region, such that each first pair of rollers grips and releases the sheet advancing into the directing region at a different instant with respect to the other first pairs of rollers; each sheet advancing into the directing region along the first and the third orientating direction is thus gripped and drawn by the first gripping and drawing means by one of the first pairs of rollers or by the second gripping and drawing means.

In the same way, in the variant the system for directing the sheets comprises a plurality of second pairs of counter-rotating rollers arranged in the directing region between the deviating means and the third gripping and drawing means one after another with reference to the advancement direction of the sheet through the directing region such that each second pair of roller grips and releases the sheet advancing in the directing region in a different instant with respect to the other second pairs of rollers; each sheet advancing in the directing region along the second and fourth orientating direction is thus gripped and drawn by the first gripping and drawing means by one of the second pairs of rollers or by the third gripping and drawing means.

The plurality of first and second pairs of counter-rotating rollers advantageously maintains the sheet constantly gripped through the directing region and also directs sheets of very small sizes.

This variant too comprises the same advantageous technical-functional characteristics of the preferred embodiment as described above, to which reference is made.

With reference to the known-type systems for directing sheet articles 2 in arrival from an input line L1 towards the two output lines C1, C2, the present invention proposes in the broadest terms a method form improving them.

These systems comprise: first gripping and drawing means 3 operating at and cooperating with the input line L1 of the sheet articles 2 which are moved in an advancement direction DA, in order to grip and draw the sheet articles 2 and release them in a directing region 37; means 4 arranged in the directing region 37 for deviating the sheet articles 2 during release thereof by the first gripping and drawing means 3, along a first D1 or a second D2 orientating direction which are angularly arranged with respect to the advancement direction DA; second gripping and drawing means 5 operating at and cooperating with a first output line C1 of the sheet articles 2 in order to grip and draw the sheet articles 2 reaching the directing region 37; third gripping and drawing means 6 operating at and cooperating with a second output line C2 of the sheet articles 2 in order to grip and draw the sheet articles 2 in arrival at the directing region 37.

The method comprises stages of: mounting at least a first pair of rollers 11A, 11B in the directing region 37 which first pair of rollers 11A, 11B are counter-rotating and opposite one another such as to cooperate with one another in order to grip the sheet articles 2 advancing along the first orientating direction D1 and to move the sheet articles 2 along a third orientating direction D3 towards the second gripping and drawing means 5 and such that during transit through the directing region 37 the sheet articles 2 advancing along the first D1 and the third orientating direction D3 are subject to a constant gripping by at least one of the first gripping and drawing means 3, the first pair 9 of rollers 11A, 11B and the second gripping and drawing means 5; mounting at least a second pair of rollers 11A, 11B in the directing region 37 which second pair of rollers 11A, 11B are counter-rotating and opposite one another such as to cooperate with one another in order to grip the sheet articles 2 advancing along the second orientating direction D2 and to move the sheet articles 2 along a fourth orientating direction D4 towards the third gripping and drawing means 6 and such that during transit through the directing region 37 the sheet articles 2 advancing along the second D2 and the fourth orientating direction D4 are subject to a constant gripping by at least one of the first gripping and drawing means 3, the second pair 10 of rollers 11A, 11B and the third gripping and drawing means 6.

An advantage of the present invention consists in having defined a method for easily improving, at low costs, an existing system for directing sheets from an input line to two output lines which enables direction sheets of any format, even smaller than standard format, while maintaining high levels of productivity.

The above has been described by way of non-limiting example, and any eventual constructional variants are considered to fall within the ambit of protection of the present technical solution, as described herein above and as claimed herein below.

The invention claimed is:

1. A system for directing sheet articles in arrival from an input line towards two output lines, comprising:

a first gripping and drawing device having an outlet section operating at and cooperating with the input line of the sheet articles which are moved in an advancement direction, in order to grip and draw the sheet articles out of the outlet section and release the sheet articles in a directing region;

a deviator arranged in the directing region for deviating the sheet articles leaving the outlet section, during release thereof by the first gripping and drawing device, along a first orienting direction or a second orientating direction which are angularly arranged with respect to the advancement direction;

a second gripping and drawing device having an input section operating at and cooperating with a first output line of the sheet articles in order to receive at the input section the sheet articles and grip and draw the sheet articles reaching the directing region;

a third gripping and drawing device having an input section operating at and cooperating with a second output line of the sheet articles in order to receive at the input section the sheet articles and grip and draw the sheet articles in arrival at the directing region;

at least one first pair of counter-rotating rollers facing one another and arranged in the directing region to grip the sheet articles advancing along the first orientating direction and to move them along a third orientating direction towards the second gripping and drawing device, the first gripping and drawing device, the first pair of rollers and the second gripping and drawing device being arranged and operating with respect to one another such that during transit through the directing region the sheet articles advancing along the first orienting direction and the third orientating direction are subjected to constant gripping by at least one from among the first gripping and drawing device, the first pair of rollers and the second gripping and drawing device;

at least one second pair of counter-rotating rollers facing one another and arranged in the directing region to grip the sheet articles advancing along the second orientating direction and to move them along a fourth direction towards the third gripping and drawing device, the first gripping and drawing device, the second pair of rollers and the third gripping and drawing device being arranged and operating with respect to one another such that during transit through the directing region the sheet articles advancing along the second orienting direction and the fourth orientating direction are subjected to constant gripping by at least one from among the first gripping and drawing device, the second pair of rollers and the third gripping and drawing device;

a first guide for guiding the sheet articles in advancement along the first orientating direction and along the third orientating direction;

a second guide for guiding the sheet articles in advancement along the second orientating direction and along the fourth orientating direction;

wherein the first guide comprises a first guide planar element and a second guide planar element, facing each other and having substantially planar developments, the first guide planar element and the second guide planar element being arranged and extending between the outlet section of the first gripping and drawing device and the input section of the second gripping and drawing device in order to receive therebetween the sheet articles from said outlet section and guide the sheet articles along the first orientating direction and along the third orientating direction toward the input section of the second gripping and drawing device;

wherein the second guide comprises a first guide planar element and a second guide planar element, facing each other and having substantially planar developments, the first guide planar element and the second guide planar element of the second guide being arranged and extending between the outlet section of the first gripping and drawing device and the input section of the third gripping and drawing device in order to receive therebetween the sheet articles from said outlet section and guide the sheet articles along the second orientating direction and along the fourth orientating direction toward the input section of the third gripping and drawing device;

and wherein each guide planar element of the first guide and the second guide is provided with a plurality of openings, portions of the rollers of the first pairs of counter-rotating rollers and the second pairs of counter-rotating rollers being inserted in each opening;

wherein each first pair of rollers and each second pair of rollers includes an idle roller, a drawing roller and a pusher for pushing the idle roller against the drawing roller, the pusher providing a predetermined contact pressure between the idle roller and the drawing roller for enabling the rollers to draw the sheet articles;

and wherein the first pair idle rollers are arranged superiorly relative to each first pair idle roller being borne rotatably by a first pair idle roller shaft, the first pair drawings rollers being arranged coaxially, and being keyed onto and constrained by a first pair common drawing roller drive shaft rotatably borne by a frame; and, wherein the second pair idle rollers are arranged inferiorly relative to the second pair drawing rollers and are coaxially arranged relative to one another, each second pair idle roller being borne rotatably by a second pair idle roller shaft, the second pair drawing rollers being arranged coaxially, and being keyed onto and constrained to a second pair common drawing roller drive shaft rotatably borne by said frame and being arranged in a position below the first pair common drawing roller drive shaft; and, wherein the first roller pairs and the second roller pairs are operable independently from each other, for gripping, drawing and moving respective sheet articles along the third orientating direction and the fourth orientating direction.

2. The system of claim 1 wherein the first pair of counter-rotating rollers is arranged such that the path of the sheet articles between the first gripping and drawing device and the first pair of rollers and the path between the first pair of rollers and the second gripping and drawing device are substantially equal.

3. The system of claim 2 wherein the second pair of counter-rotating rollers is arranged such that the path of the sheet articles between the first gripping and drawing device and the second pair of rollers and the path between the second pair of rollers and the third gripping and drawing device are substantially equal.

4. The system of claim 1 wherein the rollers of the first pair of rollers are arranged with respect to one another such that the third orientating direction is substantially equal to the first orientating direction.

5. The system of claim 4 wherein the rollers of the second pair of rollers are arranged with respect to one another such that the fourth orientating direction is substantially equal to the second orientating direction.

6. The system of claim 5 wherein the rollers of the first pair of rollers are smaller than the rollers of the pair of rollers of the second gripping and drawing device, and the rollers of the second pair of rollers are smaller than the rollers of the pair of rollers of the third gripping and drawing device.

7. The system of claim 1 wherein the second and/or the third gripping and drawing device comprise a pair of counter-rotating rollers which face one another.

8. The system of claim 7 wherein the pair of rollers of the second gripping and drawing device and/or the pair of rollers of the third gripping and drawing device are an integral part of a conveyor organ.

9. The system of claim 8 wherein the rollers of the first pair of rollers are smaller than the rollers of the pair of rollers of the second gripping and drawing device, and the rollers of the second pair are smaller than the rollers of the pair of rollers of the third gripping and drawing device.

10. The system of claim 7 wherein the rollers of the first pair of rollers are smaller than the rollers of the pair of rollers of the second gripping and drawing device, and the rollers of the second pair are smaller than the rollers of the pair of rollers of the third gripping and drawing device.

* * * * *